United States Patent [19]

Spinner

[11] Patent Number: 4,824,401

[45] Date of Patent: Apr. 25, 1989

[54] CONNECTOR FOR COAXIAL LINES WITH CORRUGATED OUTER CONDUCTOR OR FOR CORRUGATED WAVEGUIDE TUBES

[76] Inventor: Georg Spinner, Am Eichbert 12, 8152 Feldkirchen-Westerham, Fed. Rep. of Germany

[21] Appl. No.: 166,184

[22] Filed: Mar. 10, 1988

[30] Foreign Application Priority Data

Mar. 13, 1987 [DE] Fed. Rep. of Germany ..... 3708241

[51] Int. Cl.[4] ..... H01R 17/04

[52] U.S. Cl. ..... 439/584

[58] Field of Search ..... 439/583, 584

[56] References Cited

U.S. PATENT DOCUMENTS

| | | | |
|---|---|---|---|
| 2,296,766 | 9/1942 | Bruno | 439/583 |
| 2,936,440 | 5/1960 | Mack et al. | 439/583 |
| 3,678,446 | 7/1972 | Siebelist | 439/583 |

*Primary Examiner*—Joseph H. McGlynn

*Attorney, Agent, or Firm*—Henry M. Feiereisen

[57] ABSTRACT

A connector for coaxial lines with corrugated outer conductor or for corrugated waveguide tubes includes a metal casing in which an elastic plastic ring is accommodated for supporting a conductor. The plastic ring is sandwiched between the metal casing and a fastener such as a coupling ring or hollow screw, after threadably engaging the latter to the metal casing and thus becomes axially compressed and widens radially to create a form closure with the conductor.

6 Claims, 1 Drawing Sheet

CONNECTOR FOR COAXIAL LINES WITH CORRUGATED OUTER CONDUCTOR OR FOR CORRUGATED WAVEGUIDE TUBES

BACKGROUND OF THE INVENTION

The present invention refers to a connector for coaxial lines with corrugated outer conductor or for corrugated waveguide tubes.

Known connectors include a sleeve-like metal casing in which the outer conductor is fixed by a strain relief element surrounding the latter in form-locking manner. With its conductor facing end face, the strain relief element bears against a radial annular surface of a screw such as a hollow screw or a coupling ring which is threadably engaged with the metal casing.

A connector of this type is known from the DE-PS No. 35 22 736 and includes a strain relief element in form of a corrugated nut placed on the bare corrugated outer conductor and supported at its conductor-facing end face by a radial annular surface of a coupling ring which threadably engages the metal casing. The corrugated nut is generally an injection molded part of plastic material with suitable deformation-resistance on a metal part.

A sufficient form closure between the corrugated nut and the corrugated outer conductor can be accomplished only when previously removing the insulating sheath. For sealing the connector, additional seals are required since the corrugated nut does neither bear sufficiently tight against the inner wall of the sleeve-like metal casing nor against the outer conductor. Furthermore, the corrugated nut must be screwed on the outer conductor prior to a possible beading of the contacting end face of the latter, and must be exactly positioned before the outer conductor is inserted in the sleeve-like metal casing of the connector.

For corrugated waveguide tubes with elliptic cross section, such a corrugated nut is not usable at all or only in a double-parted design.

SUMMARY OF THE INVENTION

It is thus an object of the present invention to provide an improved connector of the above mentioned type obviating the afore-stated drawbacks.

This object and others which will become apparent hereinafter are attained in accordance with the present invention by arranging an elastic plastic ring in the metal casing between the latter and a fastener which is threadably engagable to the metal casing so that the plastic ring bears with one end face against a radial annular surface of the fastener and with its other opposing end face against a radial annular surface of the metal casing thereby providing a compression of the plastic ring when connecting the fastener to the metal casing.

Preferably, the plastic ring is radially elastic and after assembly is axially compressed. The provision of such a plastic ring provides numerous advantages. With respectively adjusted inner diameter, the plastic ring can be selectively placed over the bare corrugated outer conductor or corrugated waveguide tube or also over the respective insulating sheath. Through the axial compression, the outer diameter of the plastic ring is increased while its inner diameter is decreased. Further, the plastic ring provides a completely uniform distribution of the inwardly directed forces over the circumference of the outer conductor so that a deformation thereof is prevented.

In addition, the use of a plastic ring in accordance with the present invention provides a damp-proof enclosure of the connector toward the outside without requiring additional seals, especially when placing the plastic ring not directly on the bare outer conductor but over the insulating sheath thereof.

The preferably sleeve-like metal casing together with the elastic plastic ring and the fastener can be completely pre-assembled as the cable or the waveguide can easily be inserted as long as the fastener is still loosely threadably engaged. Thus, a delivery of loose parts and additional corresponding assembling steps are avoided, and the necessity of a precise positioning of the strain relief element prior to the assembly is eliminated.

Without being parted, the elastic plastic ring is usable even with corrugated waveguide tubes of elliptic cross section and with outer conductors or waveguides contacted at their end face and thus having a flanged end face.

According to a further feature of the invention, a metal ring is interposed between the facing surfaces of the plastic ring and the fastener in order to reduce friction

BRIEF DESCRIPTION OF THE DRAWING

The above and other objects, features and advantages of the present invention will now be described in more detail with reference to the accompanying drawing in which.

DETAILED DESCRIPTION OF PREFERRED EMBODIMENTS

The following description refers to a connector; however, it will be readily recognized that this is done only by way of example as the principle of the present invention may be applied also to other similar elements such as e.g. a jack or socket or a lead-through fitting.

Figure 1:
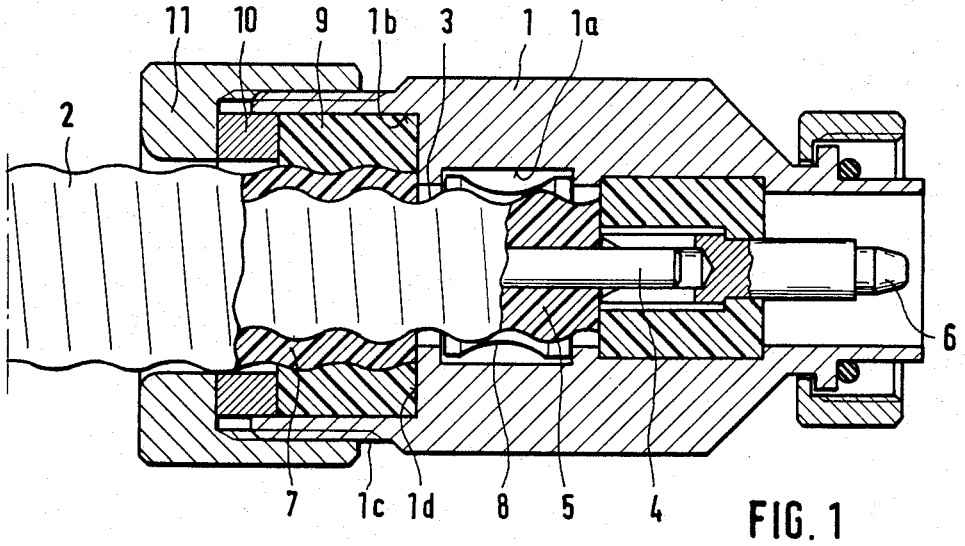
FIG. 1 is a cross sectional view of a first embodiment of a connector in accordance with the present invention.

Referring now to the drawing, and in particular to FIG. 1, there is shown a cross sectional view of a connector having a sleeve-like metal casing 1 in which a respective end of a coaxial line 2 is received. The coaxial line 2 includes a corrugated outer conductor 3 and an inner conductor 4 which passes through a dielectric 5 by means of which the inner conductor 4 is supported in a position coaxial with and insulated from the outer conductor 3. At its axial end, the inner conductor 4 is connected to a plug pin 6 in a manner not shown in detail for ease of illustration.

Surrounding the outer conductor 3 is a cable sheath or cable insulation 7 which is removed toward the end of the outer conductor 3 in order to allow the contact thereof with a spring contact ring 8 which is disposed and retained in a circumferential groove 1*a* of the metal casing 1. Spaced inwardly from the groove 1*a*, the metal casing 1 is provided with a recess or hollow 1*b* in which an elastic plastic ring 9 is accommodated for providing the strain relief. A metal ring 10 is sandwiched between the plastic ring 9 and a coupling ring 11 which is threadably engagable on the metal casing 1 along a suitable external thread 1*c*. Thus, upon screwing the coupling ring 11 to the metal casing 1, the plastic ring 9 is axially compressed and is supported by a radial annular surface 1*d* at its connector side facing end face. By means of this compression, the plastic ring 9 is forced into the corrugation of the cable sheath 7 and provides a form-locking connection. Simultaneously, a secure sealing is created against penetration of moisture into the interior space of the metal casing 1 through the conductor.

Frequently, the cable sheath is provided with an external corrugation which corresponds to the corrugation of the outer conductor except that the corrugation is less pronounced. Still, the cable sheath does not always reach with its inside surface into the "wave troughs" of the outer conductor corrugation. Through the provision of the plastic ring 9 in accordance with the invention, a radially inwardly directed force is exerted uniformly over the circumference of the cable sheath 7 so that the latter is pressed or urged into these lower areas of the corrugation of the outer conductor 3 thereby creating a secure form closure.

Figure 2:
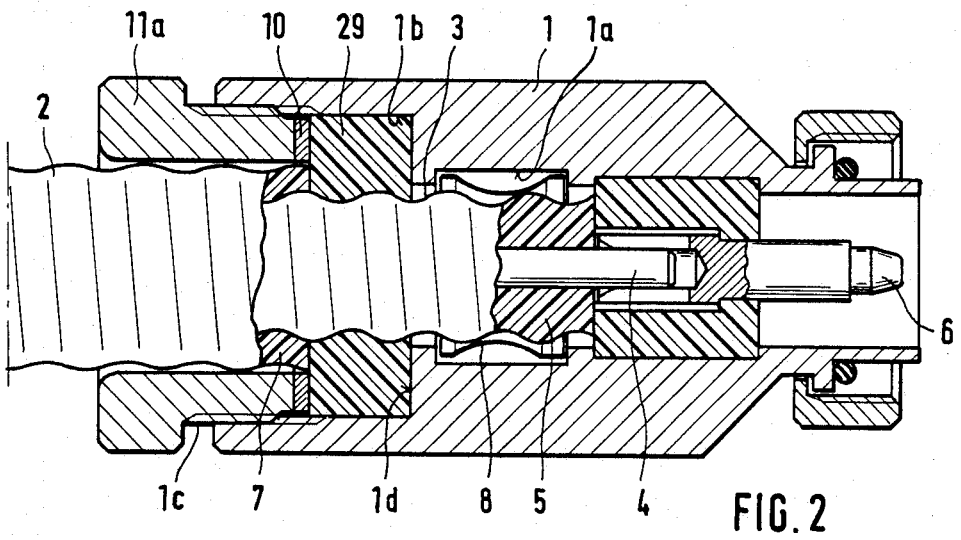
FIG. 2 is a cross sectional view of a second embodiment of a connector in accordance with the present invention.

Turning now to FIG. 2, there is shown a cross sectional view of a second embodiment of a connector in accordance with the present invention whereby same reference numerals have been used as in FIG. 1 for corresponding parts.

Accommodated in the recess 1*b* of the metal casing 1 is a plastic ring 29 which directly bears with its inner circumferential surface against the bare outer conductor 3. The cable sheath 7 is thus further shortened than in the connector of FIG. 1. To exert the necessary axial compression of the plastic ring 29, a hollow screw 11*a* is threadably engaged via an internal thread of the metal casing 1 and exerts a force toward the plastic ring 9 via the interposed metal ring 10.

Instead of the illustrated coaxial cable, it is certainly conceivable to provide such a tension-proof connection also between a corrugated waveguide tube which may even have an elliptic cross section, and e.g. a fitting.

While the invention has been illustrated and described as embodied in a Connector for Coaxial Lines with Corrugated Outer Conductor or for Corrugated Waveguide Tubes, it is not intended to be limited to the details shown since various modifications and structural changes may be made without departing in any way from the spirit of the present invention.

What is claimed as new and desired to be protected by Letters Patent is set forth in the appended claims:

1. A connector for coaxial lines with corrugated outer conductor or for corrugated waveguide tubes or the like, comprising:

a metal casing defining an interior;

fastening means threadably engagable with said metal casing; and an elastic plastic ring arranged in said metal casing and surrounding a conductor with corrugated outer surface, said plastic ring bearing with its one end face against a radial annular surface of said fastening means and bearing with its other opposing end face remote to said fastening means against a radial annular surface of said metal casing so as to be compressible by said fastening means and forced into the corrugation of the conductor to thereby provide a form-locking connection therewith and to attain a strain relief of the conductor and a sealing of said interior of said metal casing.

2. A connector as defined in claim 1 wherein said metal casing is shaped in form of a sleeve.

3. A connector as defined in claim 1 wherein said plastic ring is a radially elastic plastic ring.

4. A connector as defined in claim 1 wherein said fastening means is a hollow screw.

5. A connector as defined in claim 1 wherein said fastening means is a coupling ring.

6. A connector as defined in claim 1, and further comprising a metal ring arranged between said one end face of said plastic ring and said radial annular surface of said fastening means.

* * * * *